US010850298B1

(12) United States Patent
Kuchinski et al.

(10) Patent No.: US 10,850,298 B1
(45) Date of Patent: Dec. 1, 2020

(54) SYSTEM FOR NON-CONTACT COATING OF MOVING COMPONENT THROUGH A FALLING FLOW OF COATING MATERIAL

(71) Applicant: Madeline A. Kuchinski, Lancaster, PA (US)

(72) Inventors: Madeline A. Kuchinski, Lancaster, PA (US); Frank A. Kuchinski, Lancaster, PA (US); Stephen T. Opresko, Lancaster, PA (US); Cullen L. Hackler, Alpharetta, GA (US)

(73) Assignee: Madeline A. Kuchinski, Lancaster, PA (US)

( * ) Notice: Subject to any disclaimer, the term of this patent is extended or adjusted under 35 U.S.C. 154(b) by 338 days.

(21) Appl. No.: 15/587,882

(22) Filed: May 5, 2017

Related U.S. Application Data

(60) Provisional application No. 62/332,939, filed on May 6, 2016, provisional application No. 62/332,955, filed on May 6, 2016.

(51) Int. Cl.

| | |
|---|---|
| ***B05C 5/00*** | (2006.01) |
| ***B05B 16/20*** | (2018.01) |
| ***B05D 1/30*** | (2006.01) |
| ***B05D 1/24*** | (2006.01) |
| ***B05C 5/02*** | (2006.01) |
| ***B05C 3/10*** | (2006.01) |

(52) U.S. Cl.
CPC ..... *B05C 5/0216* (2013.01); *B05B 16/20* (2018.02); *B05C 3/10* (2013.01); *B05C 5/005* (2013.01); *B05D 1/24* (2013.01); *B05D 1/305* (2013.01)

(58) Field of Classification Search
CPC ..... B05C 5/005; B05C 5/0216; B05D 1/305; C23C 24/04; B05B 7/1486; B05B 7/14; B05B 7/149; B05B 13/0221
See application file for complete search history.

(56) References Cited

U.S. PATENT DOCUMENTS

| | | | | |
|---|---|---|---|---|
| 2,576,952 A * | 12/1951 | Lowe | ..... | A23P 20/15 118/24 |
| 2,685,537 A * | 8/1954 | Russell | ..... | A23N 17/00 118/20 |
| 2,873,843 A | 2/1959 | Wilson et al. | | |
| 3,057,325 A | 10/1962 | Nance | | |
| 2,398,517 A | 4/1964 | Castor et al. | | |
| 3,140,195 A | 7/1964 | Nagel et al. | | |

(Continued)

FOREIGN PATENT DOCUMENTS

| | | | | |
|---|---|---|---|---|
| AU | 2012200526 A1 | 8/2012 | | |
| EP | 0213781 A1 * | 3/1987 | ..... | A61L 27/045 |

(Continued)

OTHER PUBLICATIONS

Merriam-Webster, Definition of "gun", Apr. 5, 2019, https://www.merriam-webster.com/dictionary/gun, p. 2. 2019.*

*Primary Examiner* — Karl Kurple
(74) *Attorney, Agent, or Firm* — King & Schickli, PLLC

(57) ABSTRACT

An apparatus for coating an object or component includes at least one dispenser for dispensing a falling flow of material and an actuator for projecting the component through the falling flow of material. A landing may also be provided for receiving the coated projectile, the landing adapted for providing a second coating to the coated projectile. Related methods are also disclosed.

10 Claims, 10 Drawing Sheets

(56) References Cited

U.S. PATENT DOCUMENTS 3,423,489 A * 1/1969 Arens ..... B29C 70/58 264/4
3,513,012 A 5/1970 Point et al.
3,581,873 A 6/1971 Spodig et al.
3,826,226 A 7/1974 Clark
4,188,415 A 2/1980 Takahashi et al.
4,241,102 A * 12/1980 McKinley ..... B01J 2/006 209/3.1
4,242,982 A 1/1981 Drake et al.
4,341,310 A * 7/1982 Sangiovanni ..... B01F 3/0815 209/638
4,548,837 A 10/1985 Yoshino et al.
4,610,218 A * 9/1986 Johnson ..... B01J 8/085 118/303
4,702,932 A * 10/1987 Cosentino ..... B05B 5/081 118/303
4,849,289 A * 7/1989 Bernard ..... C04B 26/04 428/404
4,886,011 A * 12/1989 Gelain ..... B01J 2/006 118/308
4,895,733 A * 1/1990 Imanidis ..... B01J 2/14 118/303
5,173,326 A 12/1992 Kramer
5,180,065 A * 1/1993 Touge ..... G01N 15/1404 209/3.1
5,246,636 A * 9/1993 Lew ..... B01J 13/04 264/4
5,364,657 A * 11/1994 Throne ..... B05D 3/00 427/185
5,418,350 A * 5/1995 Freneaux ..... B05B 7/228 219/121.64
5,435,945 A * 7/1995 De Paoli ..... B01J 2/02 118/303
5,447,565 A * 9/1995 Song ..... A23G 3/2076 118/17
5,662,922 A * 9/1997 Christensen ..... A61K 31/295 424/438
5,749,938 A * 5/1998 Coombs ..... B01J 2/003 427/216
6,156,120 A * 12/2000 Heffels ..... B01F 3/1242 118/303
6,485,569 B1 * 11/2002 Sarakas ..... B01J 2/006 118/24
6,569,462 B1 * 5/2003 Cornelli ..... A61K 9/1676 424/480
7,857,297 B2 12/2010 Ong
8,182,608 B2 5/2012 Kerr et al.
8,397,664 B2 3/2013 Lin et al.
8,563,082 B2 * 10/2013 Zimmermann ..... A61K 9/1652 424/451
8,807,070 B2 * 8/2014 Jensen ..... B01J 2/006 118/303
9,233,346 B2 * 1/2016 Shinoda ..... B01F 5/0256
2003/0113475 A1 6/2003 Kitahata et al.
2004/0058065 A1 * 3/2004 Steenkiste ..... C23C 4/12 427/180
2004/0144287 A1 * 7/2004 Tardif ..... C04B 18/08 106/705
2009/0258777 A1 * 10/2009 Tardif ..... C04B 18/08 501/53
2010/0098845 A1 * 4/2010 Jensen ..... C23C 4/12 427/185
2010/0247760 A1 * 9/2010 Houben ..... B01J 2/003 427/213
2011/0177243 A1 * 7/2011 Houben ..... B01J 2/006 427/212
2013/0292081 A1 * 11/2013 Hosek ..... B22D 23/00 164/46
2015/0315714 A1 * 11/2015 Vijay ..... B08B 3/024 205/89
2016/0040278 A1 * 2/2016 Kitamura ..... C23C 4/11 427/453
2019/0070618 A1 * 3/2019 Fleischer ..... B05B 1/005

FOREIGN PATENT DOCUMENTS

GB 304812 A 1/1929
GB 1240152 A 7/1971
JP 61277303 6/1997

* cited by examiner

SYSTEM FOR NON-CONTACT COATING OF MOVING COMPONENT THROUGH A FALLING FLOW OF COATING MATERIAL

This application claims the benefit of U.S. Provisional Patent Application Ser. Nos. 62/332,939 and 62/332,955, the disclosures of which are incorporated herein by reference.

This invention was made with government support under Contract No. W912HZ15P0009 awarded by US Army Corps of Engineers (ERDC). The government has certain rights in the invention.

TECHNICAL FIELD

This application relates generally to the coating arts and, more particularly, to an apparatus and method for coating objects without handling or contact during the coating process.

BACKGROUND

Coating objects (metallic, non-metallic or otherwise) with a wet slurry or a mixture of materials is well known within the literature and manufacturing processes used throughout all industries. In fact, dipping, spraying, painting, flame coating etc. are currently in use in numerous industries in operation today.

Consider as an example where components (which is used interchangeably with the term objects) are passed through a spray coating of specific composition and then fired for curing. In this process, as well as in many others, the components being passed through the spray processing are large, and easy to handle with minimal contact during transfer from one process step to the next. Any damage due to handling is either very minimal compared to the total surface of the component or is located in an inconspicuous (non-visible) or non-critical area on the component.

As the components get physically smaller, the negative impact of handling the small components increases; it causes surface damage/poor coating characteristics to a higher percentage of the components. In fact, coating characteristics of small components often require multiple coating steps to insure good coating.

Accordingly, a need is identified for an improved apparatus and methods for coating objects without contacting the component during the coating process.

SUMMARY

The inventions of this disclosure seek to eliminate excessive handling of objects or components being coated by a coating material, such as a wet slurry or a mixture of materials, and thereby improve the coating characteristics. Small components are particularly susceptible to removal or damage of coating during handling, since in process coatings are typically not robust enough to withstand handling until after curing. This disclosure proposes combining the use of a "waterfall" ("slurry fall") technique along with a component ejection technique, optionally followed by a further (e.g., dry powder) coating prior to further (final) processing (such as firing the coating(s) for proper curing). This reduces component handling, thus improving the coating characteristics of the component and reducing rejects.

According to a first aspect of the disclosure, an apparatus for coating a component is provided. The apparatus includes at least one dispenser for dispensing a falling flow of material. An actuator, such as a gun, is also provided for projecting the component, and thus causing it to pass through the falling flow of material as a projectile without being handled.

In one embodiment, the apparatus includes a first dispenser for creating a first falling flow of material and a second dispenser for creating a second falling flow of material. The second flow of material may be formed adjacent, but separate from the first falling flow. As a result of being projected, the component may pass through the first and second falling material flows.

The first falling flow may comprise a slurry. The first falling flow may also comprise a charged flow of material, such as a charged slurry. The second flow of material may comprise a slurry or a dry powder.

The dispenser may take a variety of different forms. In one embodiment, the dispenser comprises a spray gun and the first falling flow comprises a spray. In other embodiments, the dispenser includes a plurality of orifices for generating a plurality of parallel flows of coating material.

The apparatus may further include a landing for receiving the component once coated by at least the first falling flow. The landing may comprise a dry powder bed, which may receive the coated component once it passes through the falling flow of material. Alternatively or additionally, the landing may comprise a fluidized bed for receiving the coated component once it projects through the falling flow of material.

In accordance with a further aspect of the disclosure, an apparatus for providing multiple coatings of a material on a projectile is provided. The apparatus comprises at least one dispenser for dispensing a falling flow of the material by which the projectile is coated with a first coating as the projectile passes through the falling flow of material. A landing is also provided for receiving the coated projectile, the landing adapted for providing a second coating to the coated projectile.

Still a further aspect of the disclosure pertains to a method of coating an object with a material. The method comprises projecting the object through a falling flow of the material. The projecting step may comprise projecting the object through a first falling flow of material and into a second material. The projecting step may comprise projecting the object through a first falling flow of material and through a second falling flow of material. The projecting step may comprise projecting the object into a third material, such as in a landing, following the second falling flow of material. The projecting step may comprise launching the object into the falling flow of material at a first speed and trajectory.

The method may further include the step of dispensing the falling flow of material from a dispenser. The dispensing step may comprise dispensing a plurality of falling flows of material from the dispenser. The dispensing step may also comprise the step of charging the falling flow of material.

In the following description, there are shown and described several embodiments of an apparatus and method for coating objects and, in particular, small objects (such as fibers). As it should be realized, the apparatus and method are capable of other, different embodiments and their several details are capable of modification in various, obvious aspects all without departing from the inventions as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the invention, and together with the description serve to explain certain principles thereof. In the drawing figures.

Reference will now be made in detail to embodiments of the apparatus and method, examples of which are illustrated in the accompanying drawing figures, wherein like numerals are used to represent like elements.

DETAILED DESCRIPTION

The application that will now be described includes a falling flow, or "slurry fall," coating technique that reduces component handling during processing. This improves quality of the coating on the component, while reducing manufacturing costs. The process may also allow for the application of multiple wet coats and/or one or more dry overcoats without having to handle the components being coated between the various coating steps.

Figure 1:
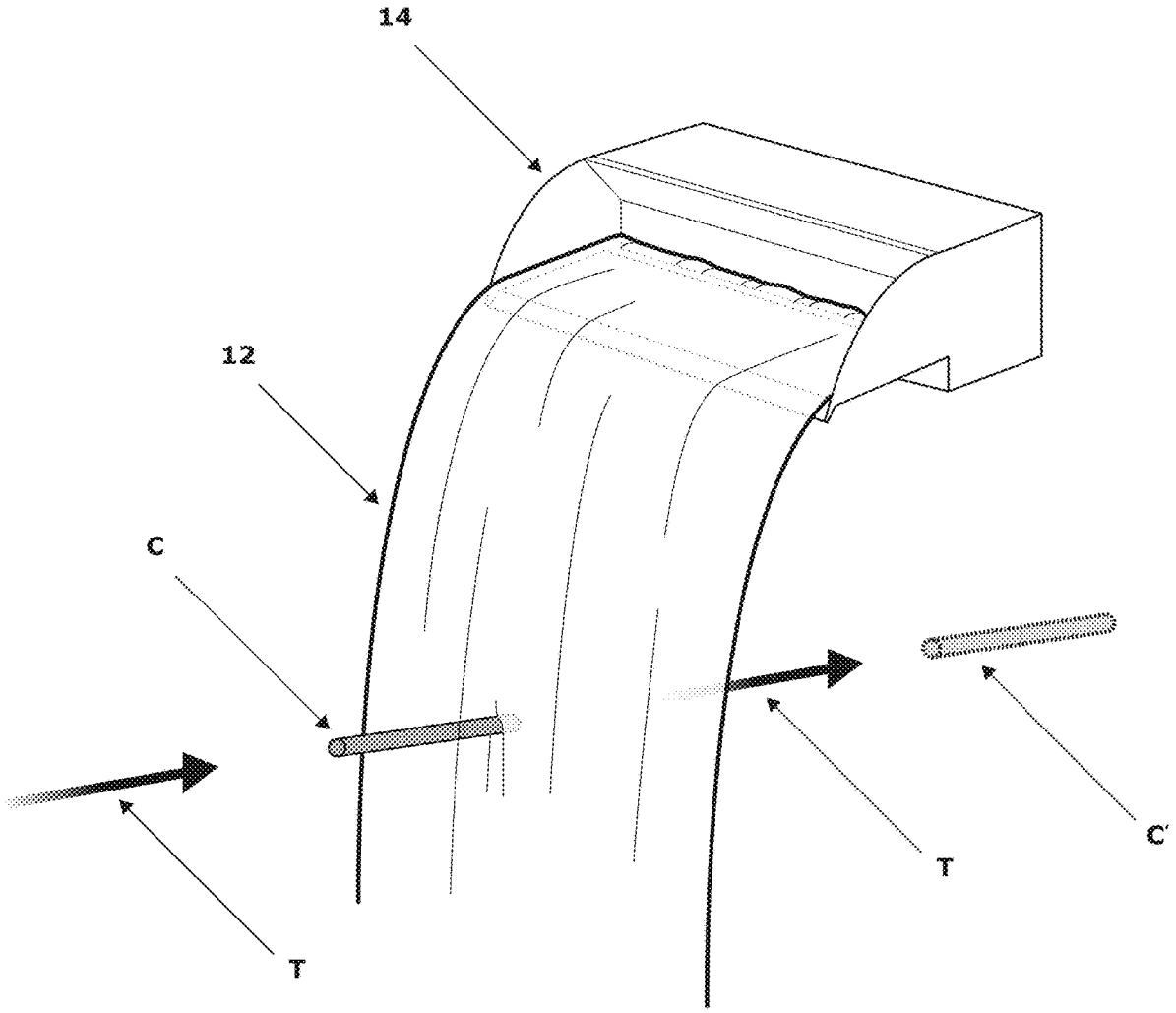
FIG. 1 is a perspective view illustrating one embodiment of a dispenser for dispensing a falling flow of a coating material for coating a projectile.
Figure 2:
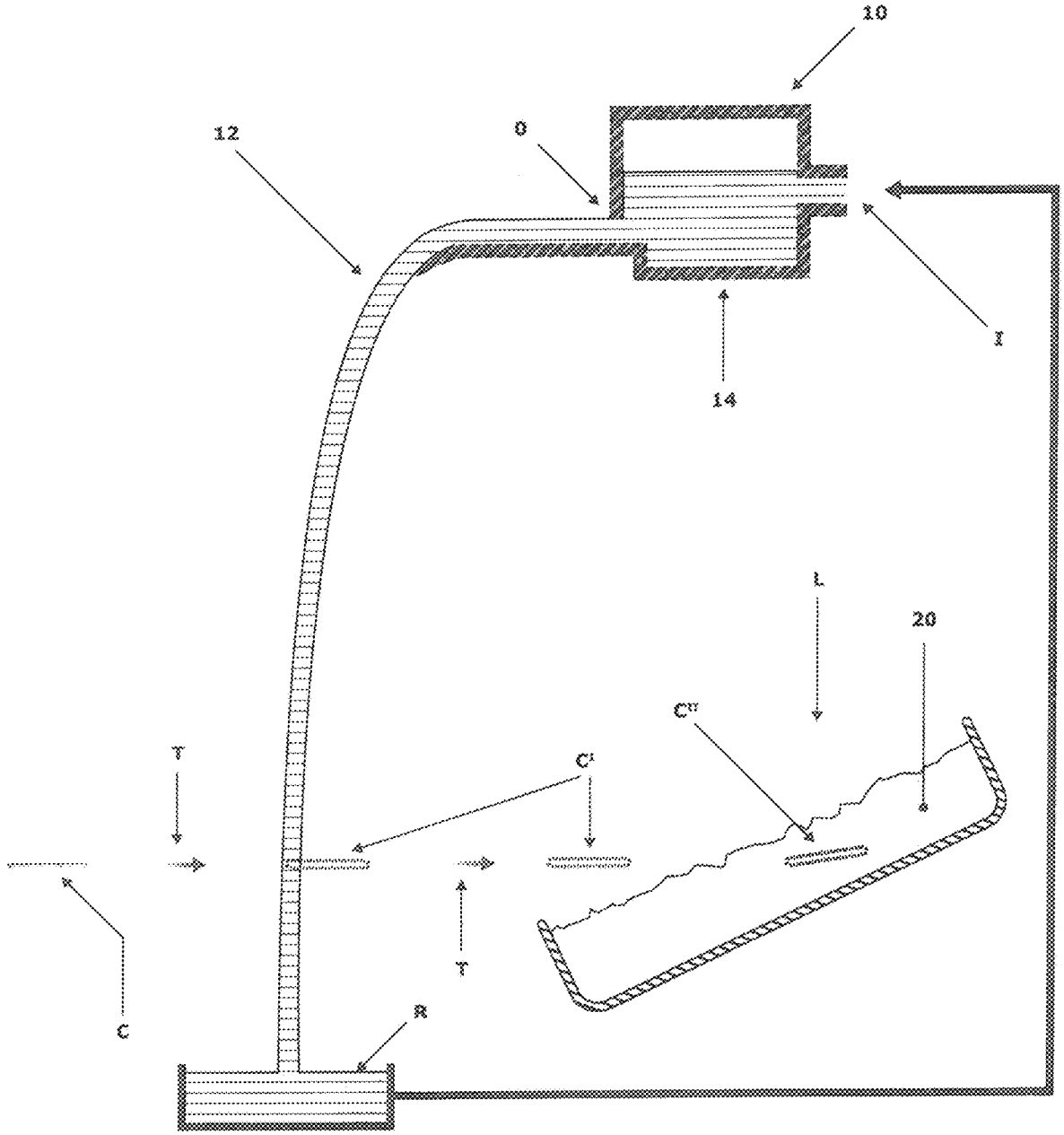
FIG. 2 is a partially cross-sectional side view illustrating the dispenser of FIG. 1 in combination with a landing for receiving the projectile once coated.

Reference is now made to FIGS. 1 and 2, which illustrate one embodiment of a process for coating a component C using an apparatus 10 for dispensing a coating material, such as a single falling flow of slurry, or "slurry fall" 12 for short. The slurry fall 12 may be generated by and flow from a dispenser 14, which is generally positioned above the location where the object or component is to receive the coating. As perhaps best understood from FIG. 2, this dispenser 14 may comprise an inlet I for receiving the slurry and an outlet O for releasing the slurry in a generally vertical direction and in a relatively wide flow (e.g., at least as wide as the component to be coated, and typically substantially wider to ensure full coverage of the coating on the component surfaces) so that the desired slurry fall 12 is created. Optionally, the slurry or other material at the terminus of the slurry fall 12 may be captured in a reservoir R and recycled to the inlet I so that a continuous loop is formed.

For purposes of applying at least a first coating, the component C may be launched toward the slurry fall 12 as a projectile. Thus, the component C may be provided with a trajectory (arrow T) and speed that moves it through the slurry fall 12 to thus form a coated component C' upon reaching the opposite side thereof. Several different approaches that can be used to instill motion in the component to form a projectile, including, for example, gravity, air/steam pressure, magnetism, compressed springs, or mechanical ejection.

Figure 3:
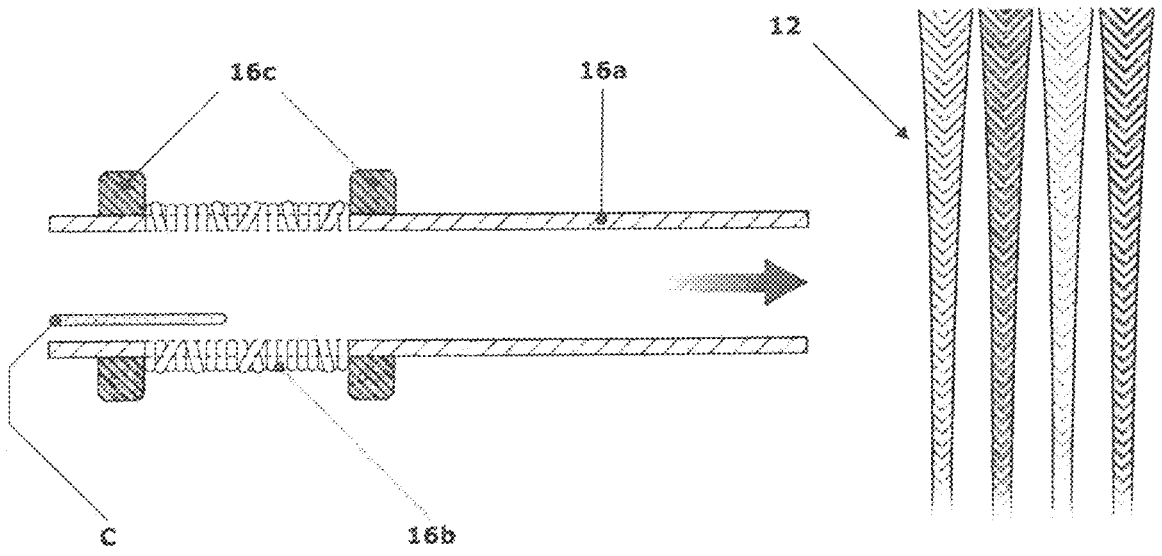
FIGS. 3 and 4 illustrate different embodiments of actuators for generating motion in an object or component to create the projectile for passing through one or more flows of coating material.

In one particular embodiment, an actuator in the form of a coil gun 16 is used for projecting the component through the coating material in a non-contact fashion. As shown in FIG. 3, one or more components C may be placed in the barrel 16*a* of the coil gun 16, such that the position of the component(s) results in maximum coupling to a magnetic field created by an outer coil 16*b* (which may be held in place by retainers 16*c*) when active (powered). Upon being ejected from the barrel 16*a*, the component(s) C pass through the coating(s), such as slurry fall 12. As a consequence of actuation and ejection from the gun 16, the component C or components may have a trajectory and speed that moves it through the coating(s) and then continues with sufficient speed/force to land at a desired location, as discussed in more detail in the following description.

Figure 4:
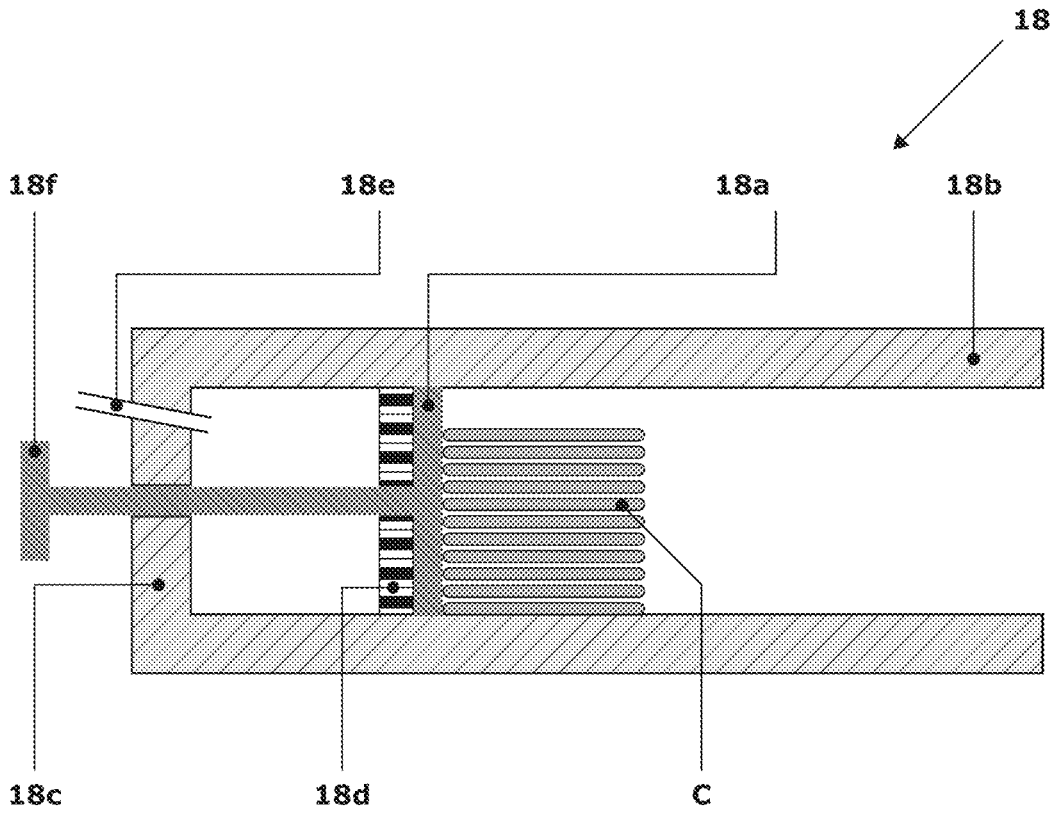

A further embodiment of an actuator is shown in FIG. 4. The actuator in this embodiment comprises a gun 18, which may include a piston 18*a* in a barrel 18*b* for receiving one or more components C. The barrel 18*b* includes a barrel stop 18*c*, which closes off the end and a fixed perforated plate 18*d* to permit fluid, such as air, to move freely between the two sections divided by the perforated plate. A fluid injection port 18*e* is included at the closed end of the barrel 18*b*, which port functions in the pneumatic mode by permitting injection of high pressure fluid, such as air, to cause the piston face to move forward in the barrel. The piston 18*a* pushes the component(s) C forward at an accelerated rate. When the piston face 18*f* reaches the barrel stop 18*c*, the piston 18*a* stops, but the associated component(s) C continue forward and are ejected from the barrel 18*b* with sufficient velocity for passing through the coating(s). To reload, the piston 18*a* is pulled back (mechanically or by applying a vacuum to the fluid injection port 18*e*) until the piston rests against the fixed perforated plate 18*d*.

In an alternative form, a mechanical mode of actuation may be applied to the gun 18. In this mode, energy is imparted to the piston 18*a* by striking it (such as along face 18*f*) with a high impact device, such as a hammer, which propels the piston forward with the same effect as described for pneumatic operation. In this mode, the fluid injection port 18*e* serves as a pressure relief device. Reloading is accomplished in the same manner as described for the pneumatic actuator.

Regardless of the particular means for imparting motion used, the force to move the component is applied such that the speed of the moving component is capable of providing sufficient travel so that the component(s) can pass through single or multiple falling slurry falls (and/or dry powder curtain(s), as noted below). As one example, for a porcelain enamel slurry with a specific gravity of about 1.55-1.70 g/cc, a steel rod with a diameter of 0.085" and a weight of about 1.0 grams would require a velocity of 10 to 50 feet per second at a trajectory of 0 to 30 degrees above horizontal to be properly coated.

After passing through the slurry fall 12, the coated component C' may land at a location, such as a landing L (which is simply a place to for coated component to come to rest), and possibly for undergoing further processing. In one example, and with reference back to FIG. 2, the coated component C' may land in a container, such as a dry powder bed 20, serving as the landing L. The bed 20 may be tilted as shown to assist in landing the component in the coating material.

Using such an arrangement, it can be appreciated that the component C is first coated by the slurry fall 12 and, while still wet, lands in a dry powder bed 20 adding a second coating (component C") without any handling, physically or otherwise. Hence, the coating uniformity and quality are not compromised. Further processing may include a thermal firing step to cure the coating once the component C is removed from the bed 20, or possibly other steps as necessary or desirable based on the particular coating(s) used.

Figure 5:
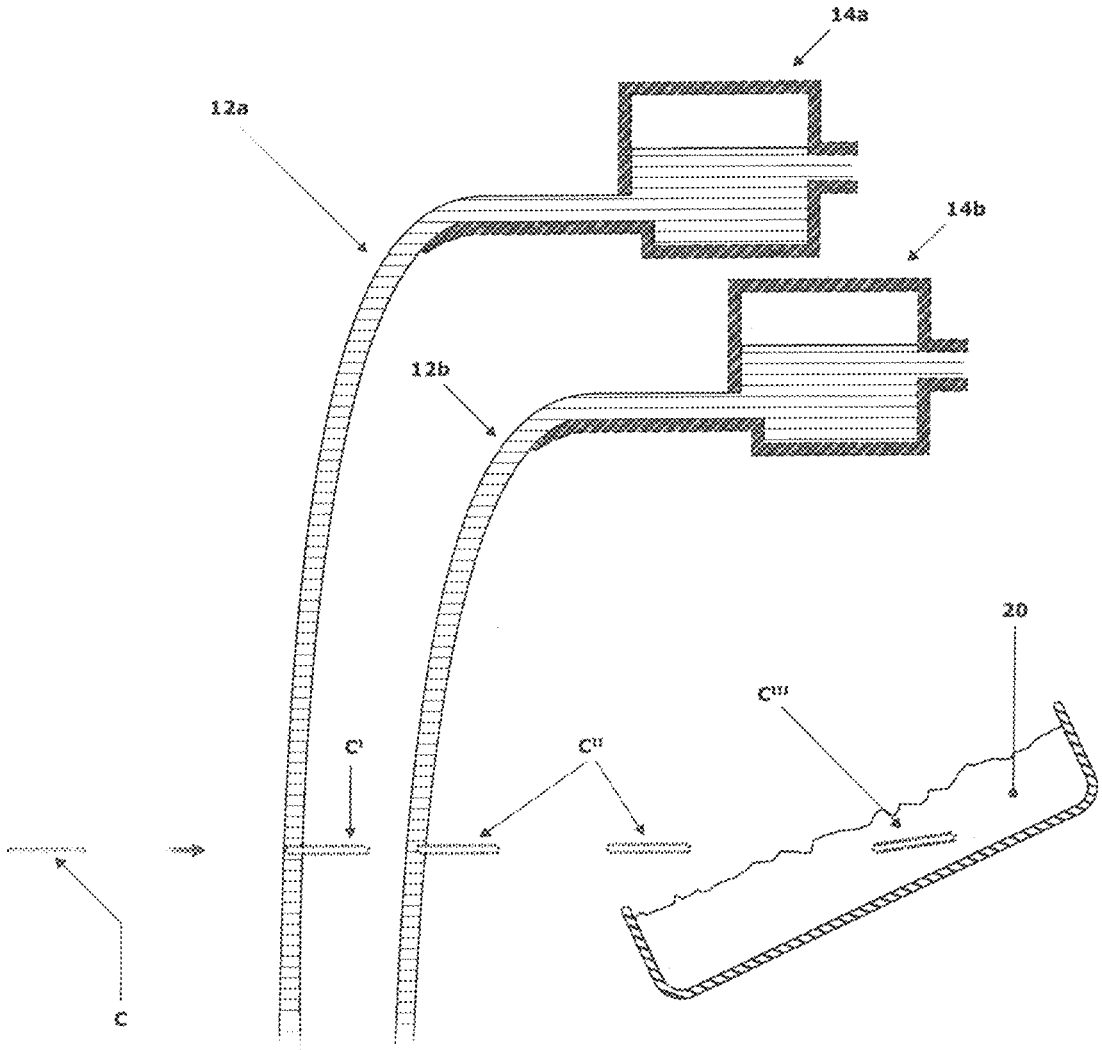
FIG. 5 is a further embodiment including plural flows of coating material for coating a projectile object.

FIG. 5 illustrates the process for a dual flow of coating materials, such as slurry falls 12*a*, 12*b*. The dual slurry falls 12*a*, 12*b* flow out of separate slurry fall dispensers 14*a*, 14*b*, which may be as described previously in relation to dispenser 14. As a result of being actuated or launched by the chosen actuator, the component C has a trajectory and speed that moves it through the dual slurry falls 12*a*, 12*b* with sufficient speed/force to pass therethrough and thus create a doubly coated component C", which may then land in a dry powder bed 20 to create a triply coated component C'". The distance between the falls 12*a*, 12*b* should be at least as large as the component being coated is long. In this embodiment, the component C is coated by two coatings of the falling slurry and, while still wet, lands in a dry powder adding the third coating without any handling, physically or otherwise, thereby avoiding compromising the coating uniformity and quality.

Figure 6:
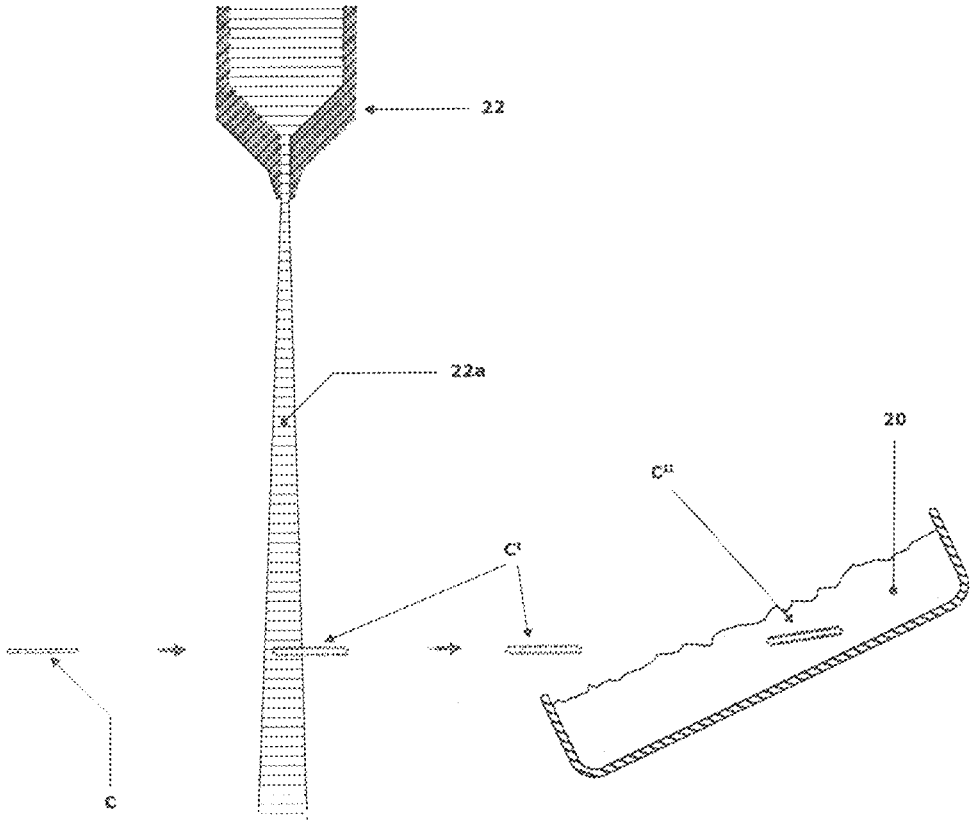
FIG. 6 illustrates the use of a dispenser in the form of a spray gun for coating a projectile.

FIG. 6 illustrates the process spraying a coating material on the component C. Specifically, coating material in the form of a slurry may be sprayed out of a gun 22 to generate a spray 22*a*, which may extend in a generally vertical direction. There may be one or more spray guns, but only one is shown in FIG. 6 for simplicity. The component C is launched as a projectile as noted above, with a trajectory and speed that moves it through the spray 22*a* (coating the component C') with sufficient force to pass through and land in the dry powder bed 20 (coating the component a second time C"). In this embodiment, the component C is coated by one coating of the sprayed material (slurry) and, while still wet, lands in a dry powder adding the second coating without any handling, physically or otherwise. Hence, the coating uniformity and quality are not compromised.

Figure 7:
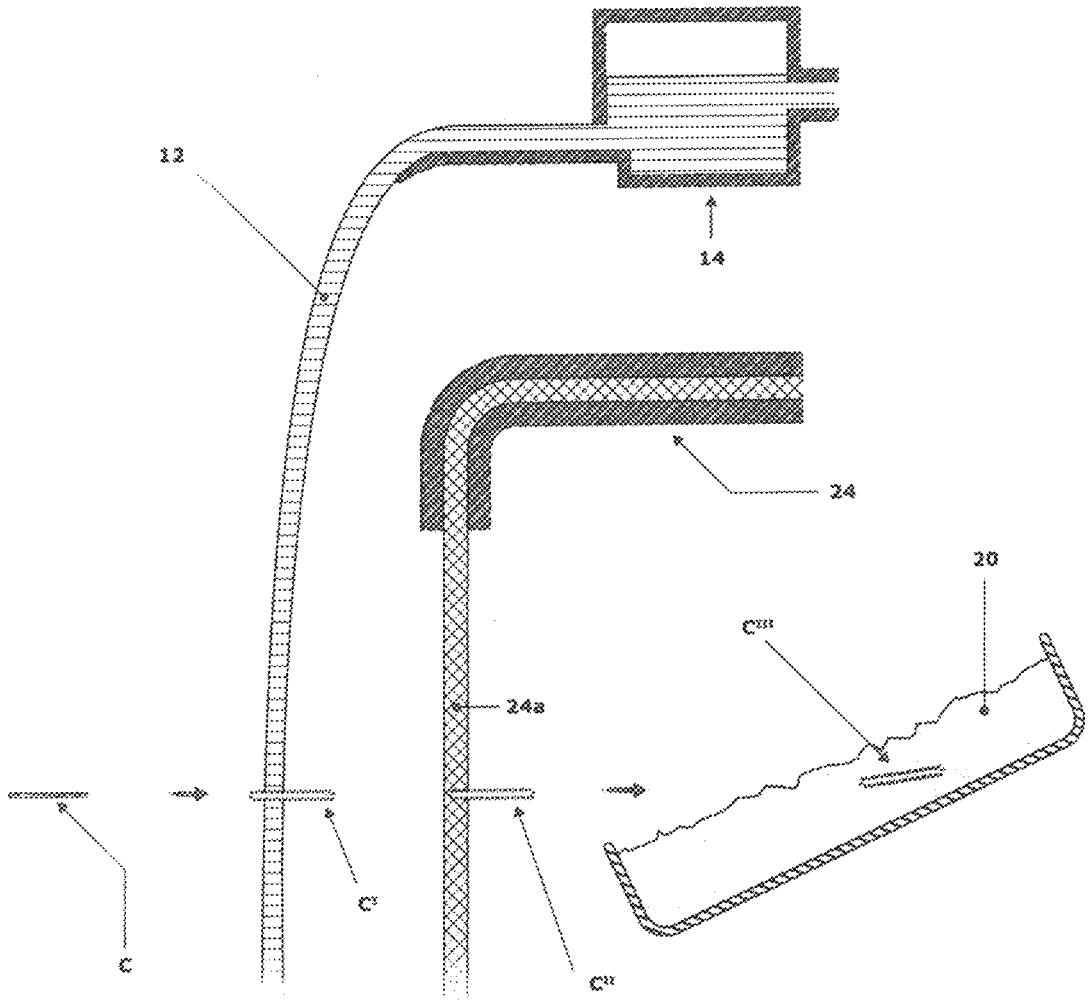
FIG. 7 is a further embodiment of the use of plural different flows of coating materials, including a wet or slurry fall followed by a dry or powder fall.

FIG. 7 illustrates the process for a falling coating material, such as a slurry, that is applied to a component C via a dispenser 14 for generating a slurry fall 12, followed by a second dispenser 24 for dispensing a dry powder curtain 24*a*, and finally landing in a dry powder bed 20. In this case, the powder curtain material and the dry powder bed material may be the same or different. The component C has a trajectory and speed that moves it through the falling slurry 12 and then passes through the powder curtain 24*a*. As a result, the component C is coated via a falling slurry 12 (component C'), followed by a dry powder curtain 24*a* (C"), finally landing in a second dry powder bed 20 (C'"), without any handling, physically or otherwise. Hence, the coating uniformity and quality are not compromised.

Figure 8:
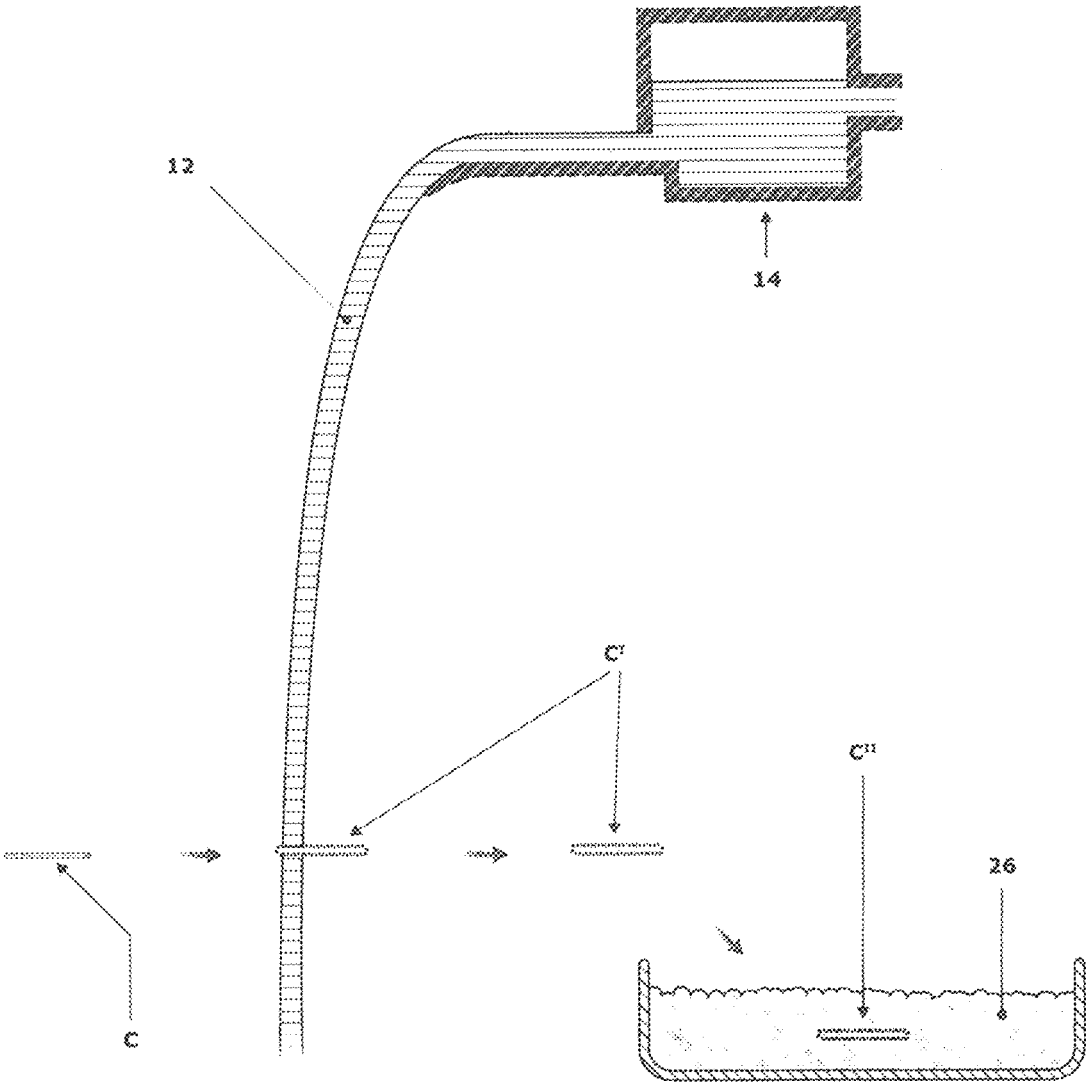
FIG. 8 is an embodiment of a coating system including a flowing fall of material and a landing in the form of a fluidized bed.

FIG. 8 illustrates the process for a falling coating material, such as falling slurry 12, applied via a dispenser 14, followed by a landing of component C in a fluidized bed 26. The component C has a trajectory and speed that moves it through the falling slurry 12, and it then falls into the fluidized bed 26, or passes through the fluidized bed 26 and lands in a dry powder bed (not shown). In this embodiment, the component(s) is/are coated via a falling slurry 12 (C') followed by landing in a fluidized bed 26 (C"), or passing through the fluidized bed 26 (C") and lands in a dry powder bed (not shown) without any handling, physically or otherwise. Hence, the coating uniformity and quality are not compromised.

Figure 9:
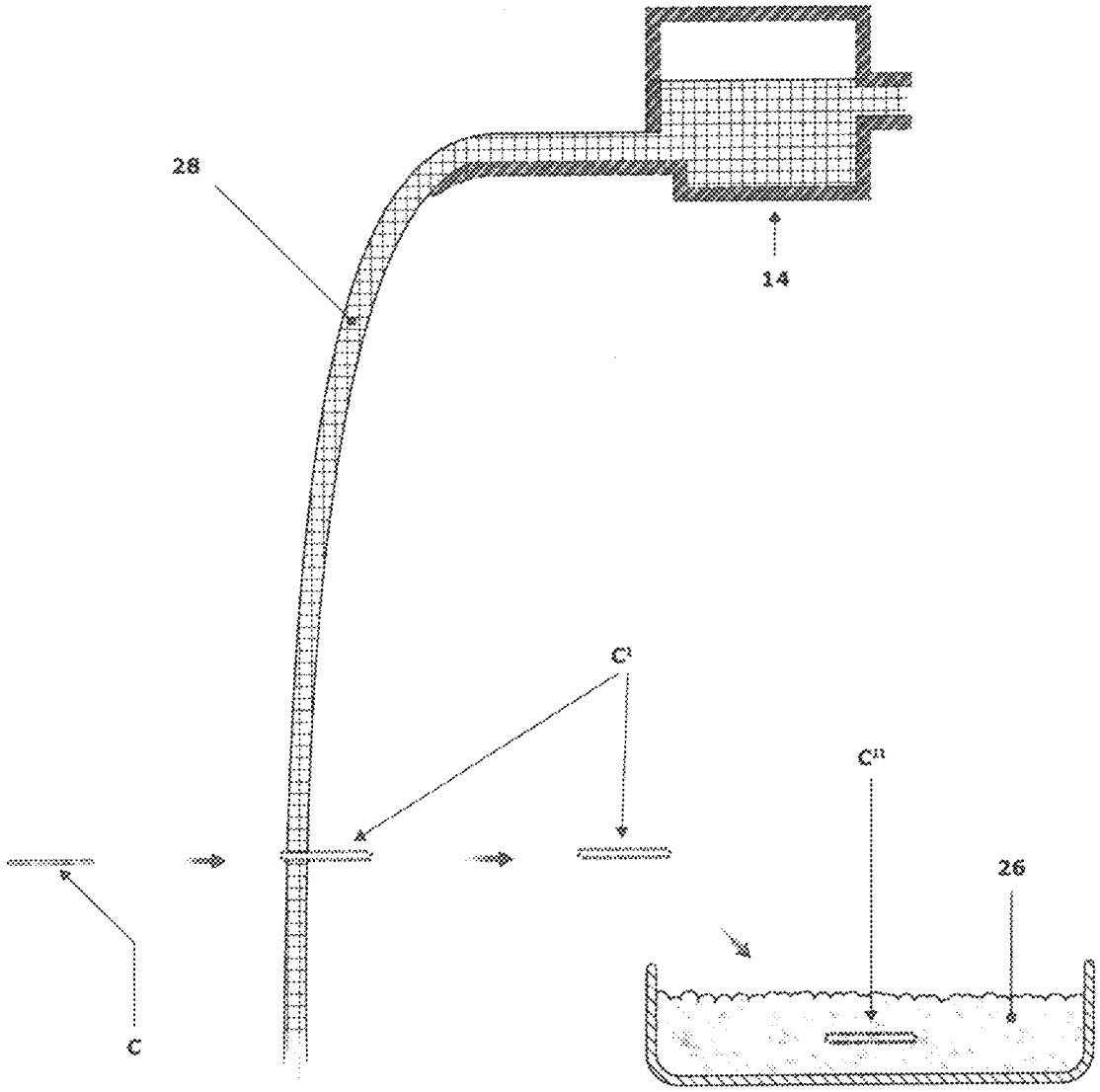
FIG. 9 is a further embodiment wherein the coating material is charged.

FIG. 9 illustrates the process for applying a charged falling flow of material 28, such as a charged slurry, to a component C in projectile form. The charged flow of material 28 may be dispensed from a dispenser 14 to create coated component C', followed by a landing of the charged and coated component C' in a fluidized bed 26 (or alternatively the dry powder bed 20). In this case, the fluidized bed 26 coats the charged component C, which has a trajectory and speed that moves it through the charged falling slurry 28 and then falls into the fluidized bed 26. In this embodiment, the component(s) is/are coated via a charged falling slurry 28 (C') followed by landing in a fluidized bed 26 to provide a further coating (C"), without any handling, physically or otherwise. Hence, the coating uniformity and quality are not compromised.

Figure 10:
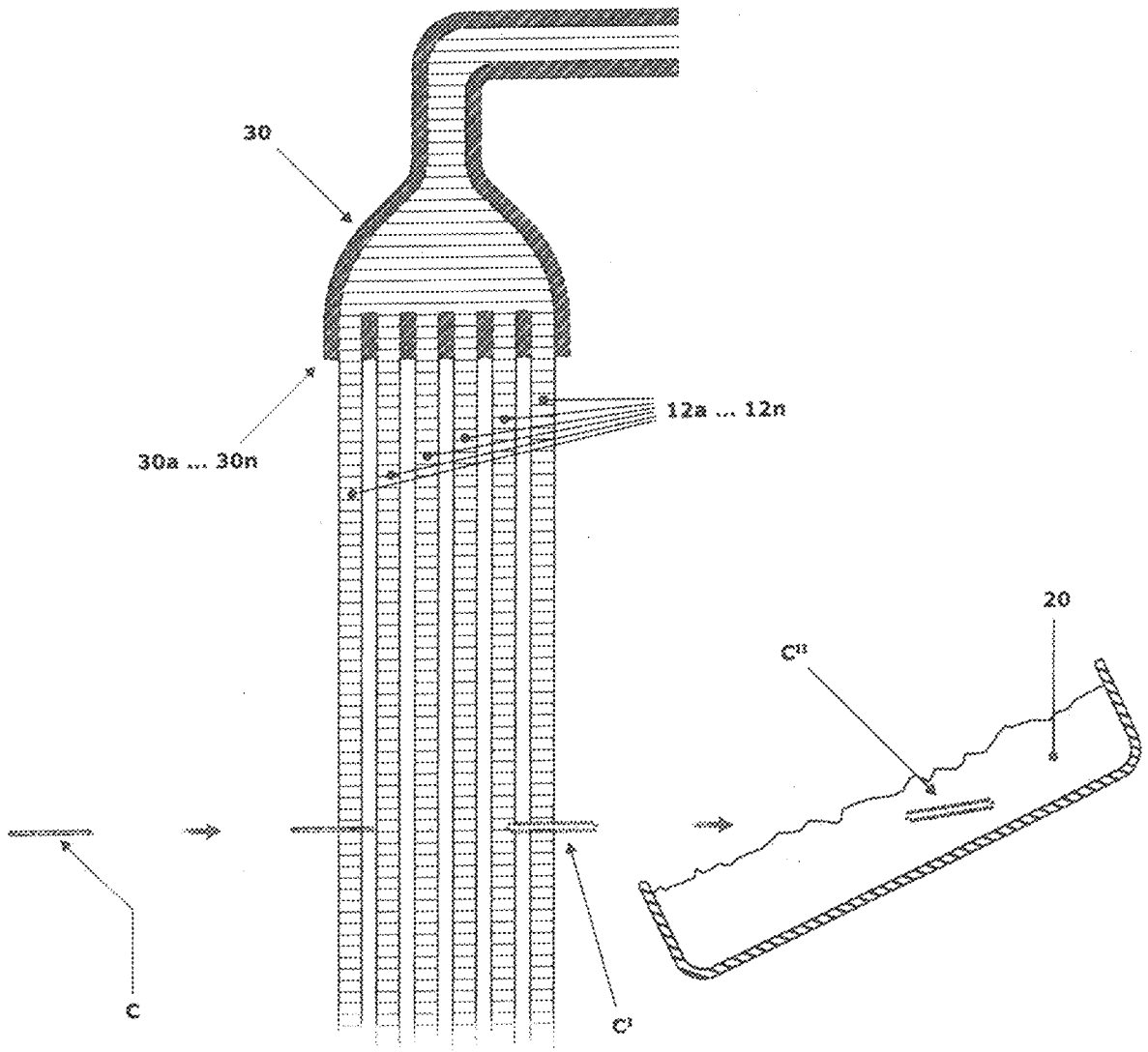
FIG. 10 illustrates a dispenser for dispensing a plurality of falling flows of material for coating a projectile.

FIG. 10 illustrates a "sprinkler head" type of dispenser 30 for a coating material, including a plurality of orifices 30*a* . . . 30*n* (which may be simple ports or nozzles). The falling coating material, such as a slurry flow, falls out of the orifices in the dispenser 14 in a plurality of falls or streams 12*a* . . . 12*n*. The component(s) C upon being launched by an actuator have a trajectory and speed that move it through the falling slurry streams 12*a* . . . 12*n* with sufficient speed/force to land in the dry powder bed 20. In this embodiment, the component(s) C are coated by the falling slurries (C') and while still wet, land in a dry powder bed 20, adding another coating (C") without any handling, physically or otherwise.

Summarizing the foregoing, the use of a falling flow of material, such as a slurry fall, 12, for coating a component in projectile form is proposed. The coating may be applied to the projected component (which may be put in motion by an actuator, such as a coil gun 16, pneumatic or mechanical gun 18, or like device) by a first slurry fall 12, which may optionally be charged. Additional coatings may subsequently be applied (such as by a dry powder bed 20, a dry powder fall 24*a*, or a fluidized bed 26). A dispenser 14 for dispensing the one or more slurry falls 12 may also be provided, and may be adapted for generating a plurality of falls of flowing material. Coating of components, including particularly small items, may thus be achieved in a reliable, repeatable manner without requiring handling during the coating steps.

The foregoing description of certain embodiments provides an illustration of the principles of the invention and its practical application to thereby enable one of ordinary skill in the art to utilize the invention in various embodiments and with various modifications as are suited to the particular use contemplated. For instance, more than one actuator may be provided for projecting objects or components through the flowing fall(s) of material, including possibly in a simultaneous manner. While active projection is desirable, the actuator could also be a passive device, such as a chute, for projecting the object or component through the flowing fall of material at a particular speed and trajectory to achieve coating without contact or handling. All such modifications and variations are within the scope of the invention as determined by the appended claims when interpreted in accordance with the breadth to which they are fairly, legally and equitably entitled.

The invention claimed is:

1. A system for coating a component, comprising: at least one dispenser for dispensing a falling flow of a material; and a gun including a barrel extending in a transverse direction, the gun configured to project the component in the transverse direction through the falling flow of the material which falls vertically; wherein the at least one dispenser comprises a first dispenser for creating a first material falling flow and further including a second dispenser for creating a second material falling flow side-by-side with the first material falling flow and the gun projects the component through the first material falling flow and the second material falling flow; wherein the first material falling flow comprises a charged material, wherein the barrel which includes a piston extending in the transverse direction in the barrel, said barrel includes a stop which closes off a first end of the barrel, a second open end of the barrel from which the component is ejected with a sufficient velocity for passing through the first falling material flow, and said piston includes a piston face which is configured to receive a force to propel the piston in the transverse direction until the piston face reaches the barrel stop whereby the component is projected in a same transverse direction as the barrel extends and out of the second open end of the barrel to a landing in a bed.

2. The system of claim 1, wherein the first material falling flow comprises a slurry.

3. The system of claim 2, wherein the first material falling flow material comprises a charged slurry.

4. The system of claim 1, wherein the landing comprises a dry powder bed.

5. The system of claim 1, wherein the landing comprises a fluidized bed.

6. The system of claim 1, wherein the first dispenser or the second dispenser is adapted for creating a plurality of material falling flows.

7. The system of claim 1, wherein the first material falling flow is at least as wide as the component.

8. The system of claim 1, wherein the component has a length, and a distance between the first material falling flow and the second material falling flow is at least as large as the length of the component.

9. The system of claim 1, wherein at least one of the the first material falling flow and the second material falling flow comprises a solid.

10. The system of claim 2, wherein the second material falling flow comprises a dry powder.

* * * * *